US006518834B2

(12) United States Patent
Gerber

(10) Patent No.: US 6,518,834 B2
(45) Date of Patent: Feb. 11, 2003

(54) CIRCUIT AND METHOD FOR REDUCING LEAKAGE CURRENT WITHIN AN ELECTRONIC SYSTEM

(75) Inventor: Remi Gerber, Tolouse (FR)

(73) Assignee: Semiconductor Components Industries LLC, Phoenix, AZ (US)

( * ) Notice: Subject to any disclaimer, the term of this patent is extended or adjusted under 35 U.S.C. 154(b) by 0 days.

(21) Appl. No.: 09/854,866

(22) Filed: May 14, 2001

(65) Prior Publication Data

US 2002/0167351 A1 Nov. 14, 2002

(51) Int. Cl.[7] ..... G05F 1/10
(52) U.S. Cl. ..... 327/544; 327/377; 320/160
(58) Field of Search ..... 327/408, 411, 327/538, 53, 66, 544, 375, 377, 383, 374, 376, 427, 432, 434, 435, 437; 359/265; 324/763; 320/160

(56) References Cited

U.S. PATENT DOCUMENTS 4,603,269 A * 7/1986 Hochstein ..... 327/432
5,978,126 A * 11/1999 Sjursen ..... 359/265
6,348,806 B1 * 2/2002 Okandan et al. ..... 324/763

* cited by examiner

*Primary Examiner*—Tuan T. Lam
*Assistant Examiner*—Hiep Nguyen

(57) ABSTRACT

A circuit for reducing leakage current through one or more output transistors (312) includes a capacitor circuit (302) and additional circuitry. The capacitor circuit (302) stores and discharges a charge, thus providing a current having a limited duration, which is related to a discharge time of the capacitor circuit. In one embodiment, the additional circuitry includes a current source circuit (304), an amplifier circuit (307), and one or more transistors (308, 310). The current source circuit is temporarily activated by the current from the capacitor circuit, and provides a second current to the amplifier circuit. The amplifier circuit amplifies the second current, and the amplifier current is used to activate the transistors (308, 310). When activated, the transistors draw current from the control terminals (e.g., the bases) of the output transistors (312) after the output transistors have been switched off, thus reducing leakage currents through the output transistors.

10 Claims, 2 Drawing Sheets

CIRCUIT AND METHOD FOR REDUCING LEAKAGE CURRENT WITHIN AN ELECTRONIC SYSTEM

BACKGROUND OF THE INVENTION

The present invention relates in general to methods and circuits for reducing power consumed while an electronic system is turned off and, more particularly, to methods and circuits that discharge residual energy from the control terminal of a transistor, where the residual energy would otherwise cause the transistor to unnecessarily consume power while the transistor is switched off.

Many electronic systems rely on batteries to supply power to the systems' circuitry. These systems include, for example, cellular telephones, pagers, radios, portable telephones, portable or remote computers, automobile electronics, and other systems. Because these systems' energy sources are limited, designing circuits that efficiently consume and conserve power is crucial to increasing a system's "useable time," which is the amount of time that the system can function on the limited battery power.

An operating cycle of a system may include an active mode, when the system is powered up, and an off mode, when the system is powered down. In addition, some system operating cycles include a standby mode, when only some of the system's circuitry is powered up. Most devices consume more power when they are in an active mode, rather than in standby mode or off mode. For example, a cellular telephone consumes much more power during a call (i.e., active mode) than when the telephone is switched off or is in standby mode, waiting for an incoming or outgoing call. While off or in standby mode, certain circuits within the telephone are not actively functioning, and thus they desirably consume little or no power.

In reality, however, even when some of the system's circuits are not actively functioning, they continue to draw some amount of energy from the battery. When prior art systems are switched off, residual energy exists on the control terminals (e.g., the bases) of various transistors, and it causes those transistors to slowly drain energy in the form of leakage current. For example, the DC-DC converters of some prior art portable devices may draw on the order of 100 microamps or more while the DC-DC converter is supposed to be switched off.

Prior art systems sometimes use a current source, during off mode, to provide a continuous, static current. When the current source is on, it draws energy from the transistor bases of some circuits (e.g., a DC-DC converter circuit), and the circuit power consumption decreases dramatically.

One problem with such prior art systems is that this continuous current still requires a certain amount of power consumption during the off mode. Accordingly, the device's useable time is decreased.

Hence, there is a need for an apparatus and method that further reduce the amount of power consumed by a circuit when the circuit is switched off. Further needed is an apparatus and method for reducing off mode power consumption, which do not rely on using a current source to draw energy from a circuit's transistors during off mode.

DETAILED DESCRIPTION OF THE DRAWINGS

In accordance with various embodiments of the present invention, and as will be described in detail below, a capacitor circuit is charged up during the active phase of a circuit or an electronic system. When the circuit or system is switched off, the capacitor circuit discharges, and the discharging energy produces a current having a limited duration. This current turns on a current source, which in turn produces a second current. This second current results in a draining of the residual energy from the control terminal of some of the electronic system's transistors. When the capacitor circuit has discharged sufficiently, the current source switches off, and the second current ceases. Accordingly, the capacitor circuit effectively acts as a battery, with a short duration, which temporarily activates the current source, causing residual energy to be discharged from a transistor circuit. In this manner, the circuit's transistors are "more off" and substantially less power is drained from the battery during the off or standby modes.

Figure 1:
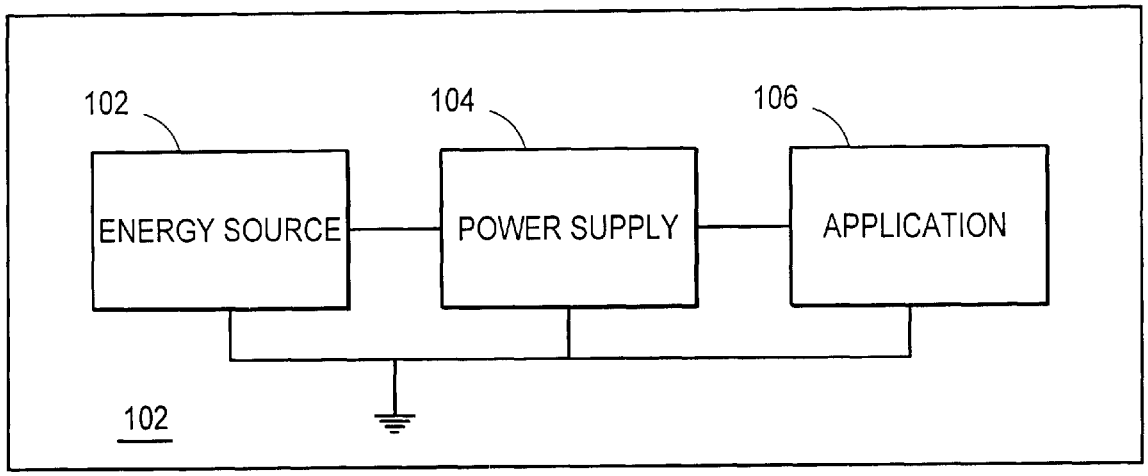
FIG. 1 is a simplified block diagram illustrating a general electronic system, in accordance with one embodiment of the present invention.

FIG. 1 is a simplified block diagram illustrating a general electronic system 100, in accordance with one embodiment of the present invention. The electronic system 100 includes energy source 102, power supply 104, and application circuitry 106. In simplified terms, these subsystems 102, 104, 106 are interconnected through ground connections. Power is managed according to application circuitry 106 requests and/or requirements, in one embodiment.

System 100 could be a fixed or portable communication, computation or other electronic device. For example, system 100 could be a cellular or portable telephone, pager, one- or two-way radio, data display device (e.g., a CD player or portable game), computer or television, automobile or aircraft electronics, or other electronic system.

Energy source 102 could be, for example, a limited energy source such as an electrochemical battery (e.g., NiCd, NiMH, sealed lead-acid, rechargeable lithium, or alkaline). In general, the various embodiments of the present invention provide substantial advantages to systems that have a limited energy source. However, the various embodiments could be used in other systems as well (e.g., systems that use a continuous or less-limited energy source), particularly when it is desirable to conserve power. For ease of explanation, the description herein refers to systems that use batteries. This is not meant to imply that the various embodiments are limited to or useful only in systems using batteries. In addition, although a battery is an example of a DC energy source, the various embodiments also could be used with other DC or AC energy sources.

Power supply 104 is used to process and control electric energy provided by energy source 102, thus supplying voltages and currents to application circuitry 106 in a well-regulated form. Power supply 104 could include, for example, a DC-DC converter, a DC-AC converter, a transformer, and/or a voltage regulator. In some embodiments, where the energy source 102 is an AC source, power supply 104 could include an AC-DC converter, a filter, and/or a rectifier.

The power provided by power supply 104 is consumed by application circuitry 106. Application circuitry 106 could be any of a large variety of different types of circuits and systems. For example, but not by way of limitation, application circuitry 106 could include any of a variety of processors, ASICs, transistor circuits (e.g., MOS transistor or BJT circuits), microcontrollers, memory devices, user interfaces, transmitters, receivers, amplifiers, and/or filters, along with a wide variety of other types of devices and circuits.

One or more circuits within power supply 104 and/or application circuitry 106 occasionally are switched off, or operate in an active mode or a standby mode. As mentioned previously, when in the active mode, a circuit typically consumes much more power than when the circuit is switched off or in the standby mode. When switched off, it is desirable that a circuit consume as little power as possible. Accordingly, in one embodiment, a method and circuit are provided which effectively discharge residual energy within a circuit, which energy would otherwise cause the circuit to unnecessarily consume power while switched off. In addition, in one embodiment, this is achieved without the use of a current source, during the off or standby modes, to supply a continuous source of current, as is done in prior art systems. Although the various embodiments are described in a certain context, below, the embodiments of the present invention are useful in virtually any electronic system or application where it is desirable to conserve energy when a transistor circuit is switched off. The scope of the claims, therefore, should not be construed to be limited to those contexts described below.

Figure 2:
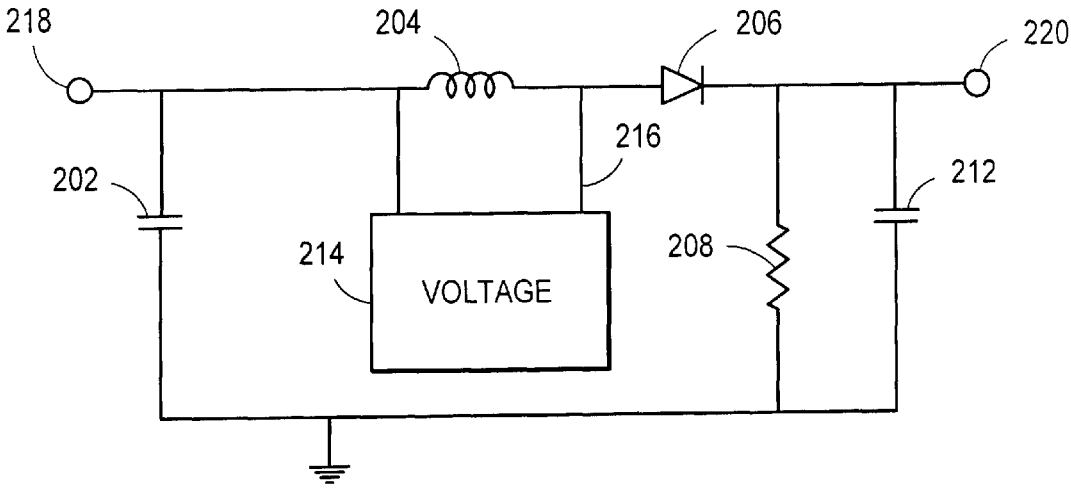
FIG. 2 is a circuit diagram illustrating an example of one application of an embodiment of the present invention.

FIG. 2 is a circuit diagram illustrating an example of one application of an embodiment of the present invention. The example circuit includes input capacitor 202, inductor 204, diode 206, resistors 208, output capacitor 212, and switching voltage regulator 214.

Voltage regulator 214 basically includes a switch and control circuitry. When switched on, lead 216 of voltage regulator 214 causes energy to flow from the input voltage terminal 218 through inductor 204 and diode 206 to the output voltage terminal 220. Therefore, voltage regulator 214 basically transfers energy from the input voltage terminal 218 to the output voltage terminal 220.

Using prior art methods, when the voltage regulator is switched off, it continues to draw a relatively small amount of energy from the input voltage source connected to input terminal 218. This occurs because residual energy on the bases of the regulator's internal transistors causes those transistors to remain slightly on. Therefore, voltage regulators of the prior art unnecessarily drain energy from the input voltage source, even when the voltage regulator is switched off.

Figure 3:
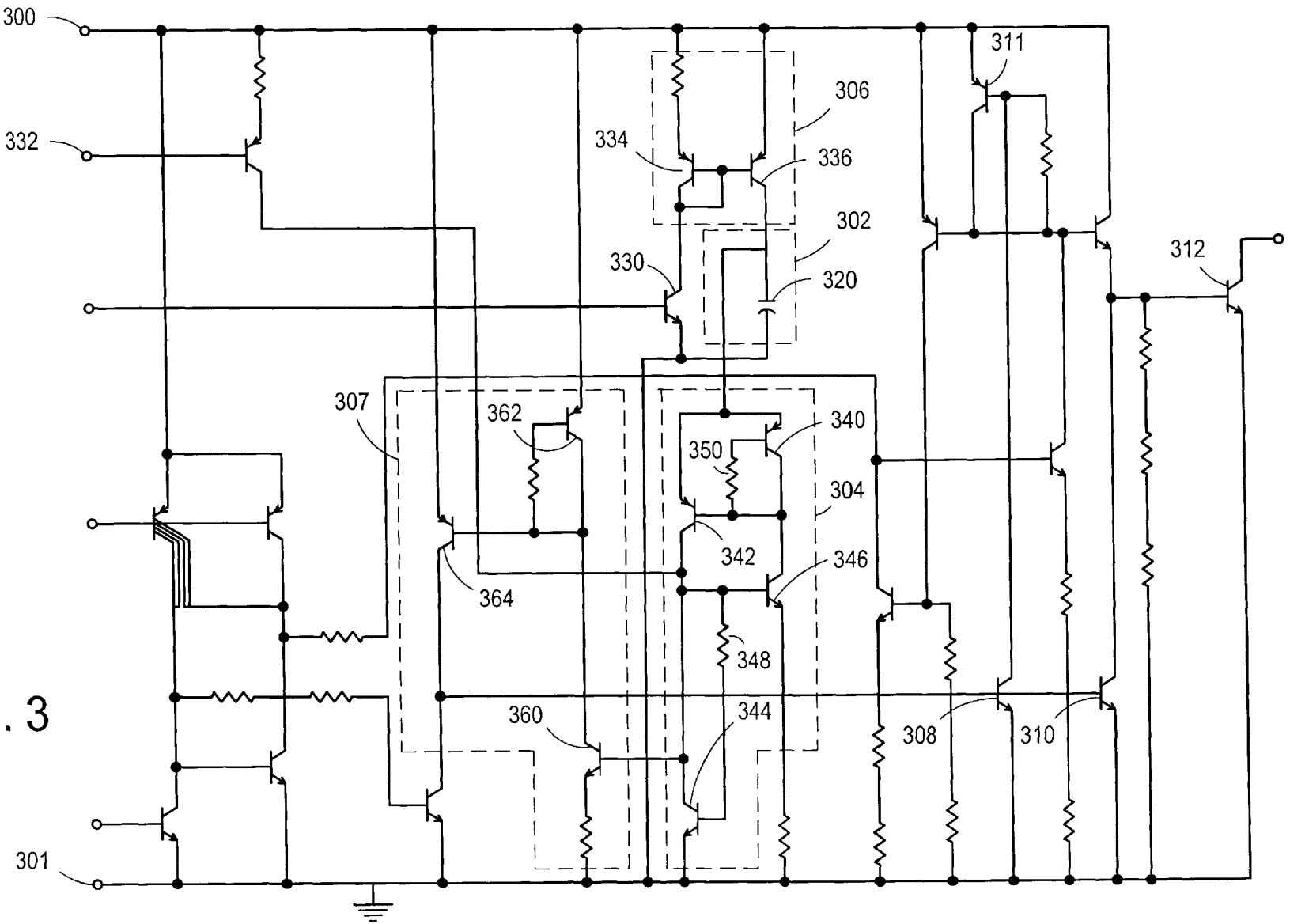
FIG. 3 is a diagram illustrating a circuit for discharging residual energy within an electronic system, in accordance with one embodiment of the present invention.

In contrast to prior art methods, when voltage regulator 214 is switched off, an internal capacitor circuit (described in conjunction with FIG. 3) discharges its stored energy, and this energy activates a current source circuit (also described in conjunction with FIG. 3). The current source circuit, in turn, causes some or all of the residual energy on the bases of the regulator's internal transistors to be drained. Accordingly, these internal transistors are "more off" than is possible using prior art methods, resulting in a much lower rate of unnecessary energy drainage from the input voltage source.

One embodiment of the internal capacitor circuit and current source are described in conjunction with FIG. 3. Although the embodiment described in conjunction with FIG. 3 can be used in a voltage regulator (e.g., regulator 214, FIG. 2), it also can be used in conjunction with many other types of circuits and applications. Accordingly, the embodiment shown in FIG. 3 is described as being used in an "electronic system."

FIG. 3 is a diagram illustrating a circuit for discharging residual energy within an electronic system, in accordance with one embodiment of the present invention. The circuit could be used in conjunction with a power supply (e.g., supply 104, FIG. 1 or voltage regulator 214, FIG. 2) or with application circuitry (e.g., circuitry 106, FIG. 1).

In one embodiment, the circuit is connected to a positive supply voltage terminal 300 (e.g., which connects to a battery having voltage Vcc) and to a ground terminal 301. In one embodiment, the positive supply voltage is in a range of 1.7 to 6.0 volts, although the supply could have voltages higher or lower than this range, as well.

The circuit includes capacitor circuit 302 and additional circuitry that is responsive to a current produced by capacitor circuit 302. In one embodiment, this additional circuitry includes some or all of the following elements: current source circuit 304, amplifier circuit 307, and residual energy draining transistors 308, 310. The collectors of transistors 308, 310 are connected to the control terminals (e.g., the bases) of at least one transistor 311, 312, from which it is desired to drain residual energy when the transistors 311, 312 are switched off. Although the description, below, refers to draining residual energy from the "base" of transistors 311, 312, such energy could be drained from other types of control terminals (e.g., the gate of an FET), in other embodiments.

In one embodiment, when output transistor 312 is switched on, it draws energy from an input energy source (e.g., energy source 102, FIG. 1 or 218, FIG. 2) via transistor 311. When transistors 311, 312 are switched off, they should drain little or no energy from the input energy source. By draining the residual energy from the bases of transistors 311 and 312, in accordance with one embodiment, transistors 311, 312 are switched "more off" than is possible using many prior art circuits. Accordingly, transistors 311, 312 drain much less energy than is drained using those prior art circuits. This is accomplished without the use of a continuous current source to drain energy from the transistor bases while they are switched off, as is done in prior art systems.

Capacitor circuit 302 includes a single capacitor 320, in one embodiment. In other embodiments, capacitor circuit 302 could include multiple capacitors and/or other elements, connected in series, parallel, or a combination. The function of capacitor circuit 302 is to produce a stored charge. The stored charge is then discharged by the capacitor circuit, providing a current with a limited duration. The duration of the current is related to the discharge time of the capacitor circuit. As will be explained further below, the limited-duration current is received by additional circuitry which, in response to the current, draws another current from the control terminal (e.g., the base) of output driver transistor 312, after transistor 312 has been switched off. This results in a reduction of leakage current through transistor 312.

Capacitor circuit 302 is charged up, in one embodiment, using current mirror circuit 306. Current mirror circuit 306 is activated using transistor 330, which can be, for example, an NPN BJT, which has a base that is provided a current through a control lead 332. Current mirror circuit 306 includes transistors 334, 336, in one embodiment. Transistors 334 and 336 are PNP transistors, in one embodiment. When they are activated, the current through transistor 334 is mirrored by transistor 336, thus providing energy to capacitor circuit 302, and causing capacitor circuit 302 to be charged up (e.g., to Vcc). In one embodiment, transistor 336 provides a current that is some ratio of the current through transistor 334. For example, the ratio of current through transistor 336 to transistor 334 could be 2:1. Alternatively, other ratios could be used.

When transistor 312 is switched off, the charged up capacitor circuit 302 discharges, producing a time-decaying current, referred to herein as a "discharge current." The discharge current has a duration that is related to the discharge time of capacitor circuit 302. When capacitor circuit 302 is not charged up, no discharge current is produced.

The discharge current is received by additional circuitry, which ultimately draws current from the control terminal of a transistor that has been switched off, in order to reduce the leakage current through that transistor. In one embodiment, this additional circuitry includes current source circuit 304, amplifier circuit 307, and one or more transistors 308, 310. Each of these elements, in turn, produces another current in response to the current received from a preceding element. Therefore, current source circuit 304 produces a current in response to the discharge current from capacitor circuit 302, amplifier circuit 307 produces a current in response to the current from current source circuit 304, and transistors 308, 310 produce currents in response to the current from amplifier circuit 307. Thus, ultimately, transistors 308, 310 produce a current in response to the discharge current from capacitor circuit 302.

The discharge current from capacitor circuit 302 activates current source circuit 304, in one embodiment, which is coupled to capacitor circuit 302. In one embodiment, current source circuit 304 includes one or more transistors 340, 342, 344, 346, and one or more resistors 348, 350. These components are coupled together in such a way (e.g., as shown in FIG. 3) that they produce a second current at the collector of transistor 344, referred to herein as the "current source current," when the bases of transistors 340, 342, 344, and 346 are activated in response to the discharge current. The duration of the current source current is related to the duration of the discharge current. When the magnitude of the discharge current drops below a certain level, current source circuit 304 ceases to produce a current.

The current produced by current source circuit 304 is received by and amplified by amplifier circuit 307. In one embodiment, amplifier circuit 307 includes transistors 360, 362, and 364. The current from current source circuit 304 is received by transistor 360, in one embodiment. The current through transistor 360 activates transistors 362 and 364, in one embodiment. Transistors 362 and 364 are basically used to amplify the current through transistor 360.

When activated, transistor 364 produces a current at its collector, which is provided to the bases of residual energy draining transistors 308, 310, thus activating the control terminals of those transistors as long as the current is present. The collectors of transistors 308, 310 are electrically coupled to the bases of transistors 311, 312, where transistor 312 is considered the output driver transistor. In one embodiment, the output driver transistor 312 is a switching transistor, which draws energy from the input voltage source when transistor 312 is switched on.

When activated, transistors 308, 310 draw current from the bases of transistors 311, 312. Because transistors 308, 310 are generally activated when transistors 311, 312 have already been switched off, transistors 308, 310 draw residual energy (i.e., unwanted energy) from the bases of transistors 311, 312. The residual energy is energy present at the bases of transistors 311, 312 during the transistors' off mode, and this energy, if not discharged, would otherwise cause transistors 311, 312 to be "slightly on" and draining energy from the input voltage source. Accordingly, by drawing the current from the control terminals of transistors 311, 312, the leakage currents through transistors 311, 312 are reduced.

In summary, the various embodiments provide a circuit, wherein a limited duration current produced by a charge stored within capacitor circuit 302 is used by additional circuitry to discharge residual energy at the base of one or more transistors (e.g., transistors 311, 312). Once discharged, capacitor circuit 302 no longer produces a current. Accordingly, capacitor circuit 302 enables various transistors to be turned more fully off, reducing the amount of leakage current drawn by the transistors when they are intended to be off. This reduction in leakage current is accomplished without the use of a continuous current source, and results in less unnecessary drainage of a system's batteries, and an increase in the operational time of the system.

A capacitor circuit 302 such as the circuit described in conjunction with FIG. 3, along with other circuit embodiments that achieve the same result, can be used to discharge residual current in a wide variety of applications. Therefore, the particular applications described above are not meant to be limiting. Instead, the use of a capacitor circuit it to discharge residual energy should be construed to be applicable in a wide variety of applications and with a wide range of other circuit embodiments.

In the foregoing detailed description, reference is made to the accompanying drawings, which form a part hereof, and in which are shown by way of illustration specific embodiments. These embodiments are illustrated and described in sufficient detail to enable those skilled in the art to practice the embodiments. The figures are intended to illustrate various embodiments, which can be understood and appropriately carried out by those of ordinary skill in the art.

The foregoing detailed description uses terms that are provided in order to make the detailed description more easily understandable. It is to be understood that these terms and the phraseology employed in the description should not be construed to limit the scope of the invention.

It will be appreciated by those of ordinary skill in the art that any arrangement, which is calculated to achieve the same purpose, may be substituted for the specific embodiment shown. For example, various circuit configurations are shown to achieve desired output currents. Those of ordinary skill in the art could modify the illustrated configurations to achieve the same output currents. In addition, although the figures show some transistors as being PNP BJTs, the circuits could be modified so that NPN BJTs could be used instead, and vice versa. In still other embodiments, field effect transistors could be substituted for some or all of the BJTs.

This application is intended to cover any adaptations or variations of the present invention that fall within its scope. The foregoing detailed description, therefore, is not to be taken in a limiting sense, and it will be readily understood by those skilled in the art that various changes in the details, materials, and arrangements of the parts and operations which have been described and illustrated in order to explain the nature of this invention may be made without departing from the scope of the invention as expressed in the adjoining claims.

What is claimed is:

1. A power supply circuit, comprising:

a capacitor circuit, which discharges a stored charge, thus providing a first current having a limited duration, which is related to a discharge time of the capacitor circuit;

a current mirror circuit for providing energy to the capacitor to produce the stored charge; and additional circuitry, coupled to the capacitor circuit, which, in response to the first current, draws a second current from a control terminal of a first transistor after the first transistor has been switched off, thus reducing leakage current through the first transistor.

2. The circuit of claim 1, wherein the additional circuitry includes:

the a second transistor, which is electrically connected to the control terminal of the first transistor, wherein a control terminal of the second transistor is activated in response to the first current, causing the second transistor to draw the second current.

3. The circuit of claim 2, wherein the additional circuitry further includes:

a current source circuit, coupled to the capacitor circuit, wherein the current source circuit is activated by the first current and produces a third current in response to being activated, and the third current is used to activate the control terminal of the second transistor.

4. The circuit of claim 3, wherein the additional circuitry further includes:

an amplifier circuit, coupled to the current source circuit, wherein the amplifier circuit receives and amplifies the third current, producing a fourth current, which is applied to the control terminal of the second transistor.

5. The circuit of claim 1, wherein the first transistor is a bipolar junction transistor, and the control terminal is a base of the first transistor.

6. A method of reducing leakage current through a first transistor, the method comprising:

producing a stored charge in a capacitor circuit, wherein producing the stored charge includes mirroring a current to the capacitor circuit to produce the stored charge;

discharging the stored charge, by the capacitor circuit, thus providing a first current having a limited duration, which is related to a discharge time of the capacitor circuit; and in response to the first current, drawing a second current, by additional circuitry coupled to the capacitor circuit, from a control terminal of the first transistor after the first transistor has been switched off, thus reducing leakage current through the first transistor.

7. The method of claim 6, wherein drawing the second current includes:

activating a control terminal of a second transistor in response to the first current, causing the second transistor to draw the second current.

8. The method of claim 7, wherein drawing the second current further includes:

activating a current source circuit with the first current; and producing, by the current source circuit, a third current in response to being activated, wherein the third current is used to activate the control terminal of the second transistor.

9. The method of claim 8, wherein drawing the second current further includes:

receiving and amplifying the third current, by an amplifier circuit, to produce a fourth current, which is applied to the control terminal of the second transistor.

10. The circuit of claim 6, wherein the first transistor is a bipolar junction transistor, and the control terminal is a base of the first transistor, and wherein drawing the second current includes drawing the second current from the base of the first transistor.

* * * * *